United States Patent [19]

Schymura et al.

[11] 4,221,341

[45] Sep. 9, 1980

[54] SINTER BREAKER

[75] Inventors: Konrad Schymura, Oberursel; Manfred Schafer, Frankfurt, Main-Harheim, both of Fed. Rep. of Germany

[73] Assignee: Dravo Corporation, Pittsburgh, Pa.

[21] Appl. No.: 937,788

[22] Filed: Aug. 29, 1978

[30] Foreign Application Priority Data

Sep. 23, 1977 [DE] Fed. Rep. of Germany ..... 2742880

[51] Int. Cl.[3] ..... B02C 13/28

[52] U.S. Cl. ..... 241/67; 241/88.4; 241/190

[58] Field of Search ..... 165/47, 92, 177; 241/65, 66, 67, 243, 261, 189 R, 190, 88.4, 86, 88

[56] References Cited

U.S. PATENT DOCUMENTS 3,563,710 2/1971 Dew, Jr. et al. ..... 165/92 X

FOREIGN PATENT DOCUMENTS 689431 4/1967 Belgium ..... 241/67
2216120 10/1975 Fed. Rep. of Germany ..... 241/66
2234019 5/1976 Fed. Rep. of Germany ..... 241/67

*Primary Examiner*—Mark Rosenbaum
*Attorney, Agent, or Firm*—Parmelee, Miller, Welsh & Kratz

[57] ABSTRACT

A sinter crushing machine having a crushing screen and a crushing roll, the screen having hollow teeth with nozzle means for directing a spray of coolant over the working surfaces thereof and the roll having hollow spikes with nozzle means for directing a spray of coolant, such that the working surfaces of the screen and roll are respectively cooled by a substantially uniform amount of coolant at substantially uniform temperatures.

7 Claims, 3 Drawing Figures

SINTER BREAKER

BACKGROUND OF THE INVENTION

The present invention relates to a sinter crusher, comprising a crushing screen member and crushing roll member, each with spaced crushing elements extending therealong so arranged and spaced that the screen supports hot sinter on its crushing elements and, upon rotation, the crushing elements of the roll member pass between the crushing elements of the screen member to fragment the hot sinter supported on the screen member and force the fragments through the screen member. More particularly, this invention relates to the novel construction of said crushing members for effectively cooling them.

The hot sinter which is discharged by sintering machines is reduced in size by sinter crushers. Since the sinter still has a temperature of several hundred degrees, the working surfaces of the sinter crusher are subject to great stresses, wear relatively quickly and must therefore be changed quite often. Of course, the wear can be reduced by a highly heat-resistant and durable design of the working surfaces, for example by designing it with high-chromium steels or by added carbide coating, but even then there is still a very considerable wear experienced. Another possibility of reducing the wear is the cooling of the working surfaces of the sinter crusher.

From DT-AS No. 22 16 120 a sinter crusher is known on which cross-bearer of the crushing screen is on bearings at each end, with a hollow space as well as supply and withdrawal lines for the cooling medium. For simplification of the supply and withdrawal of the cooling medium to each cross-bearer the hollow cavity of each cross-bearer is separated into two chambers by means of a longitudinal divider wall, which at one end of the individual screen cross-bearer has the supply emptying into the one chamber and the removal taking place from the other chamber, and both chambers are connected to each other at the other end of the screen cross-bearer.

This configuration of the screen cross-members is also known from BE-PS No. 689 431. In addition, here too the shaft and the crushing spikes are hollow and are flushed with the cooling medium one after the other. The configuration of the screen cross-bearers is relatively expensive. In addition, there are large temperature differences in the cooling medium during the cooling process, unless a very large amount of cooling medium is fed through. This is true to an increased extent in the cooling of the crushing spikes, since these are flushed one after the other. Moreover, the cooling medium, as a result of the lower circuit resistance, flows principally through the shaft, so that the cooling of the crushing spikes is poor.

DT-AS No. 22 34 019 describes a cooling of the crushing spikes and the shaft in a manner so that the shaft is surrounded by a casing, and the hollow cavities of the crushing spikes are connected by the hollow cavity between the shaft and the casing, and in the hollow cavities of the crushing spikes separating walls are added for a directed circulation flow of the cooling medium to the sections which are radially the farthest away. The cooling medium flows through all the crushing spikes one after the other in succession. With this design, of course, the cooling medium is forced into the outermost parts of the crushing spikes, but for this, a rather expensive construction is necessary. In addition, there is no elimination of the great differences in the temperature of the cooling medium in the individual parts to be cooled.

The object of the present invention is the improvement of the cooling of sinter crushers and to keep the expenditures necessary for this purpose as low as possible.

The solution of this problem is achieved by means of the invention in that the crushing screen member is designed as a bracketed or multi-toothed screen. It consists of a hollow outer covering with hollow crushing teeth, and in the outer covering is located a supply line for the cooling medium with outlet openings in the form of nozzles in the hollow cavity of each individual crushing tooth, and the hollow space of each individual crushing tooth is connected with the hollow space of the outer covering by means of return openings for the heated cooling medium in the wall of the outer covering, and the outer covering is equipped with a drain. The working surfaces of the sinter crusher can be covered with carbide metals or can consist of carbide metals. The cooling medium can consist of water, whereby a spraying of water with cooling by evaporation is possible, or it can consist of air or an air-water mixture, of steam or other media with a good heat transfer property.

A significant improvement lies in the fact that the outer covering of the bracketed screen is designed as a tube. This achieves the best durability values at torsion loads.

A significant improvement lies in the fact that the outlet openings in the form of nozzles are located in the hollow spaces of the crushing teeth by means of extension pieces in the vicinity of the working surfaces of the crushing teeth to be cooled. This achieves an especially good cooling of the working surfaces, especially when the hollow space is completely filled with the cooling medium, since a strong turbulence of the flow at the working surfaces is produced. The direction of the flow of the cooling medium directly on the working surfaces is considerably improved as compared to outlet openings which end at about the level of the wall of the outer covering.

A significant improvement lies in the fact that the crushing roll member is designed as a hollow body, and in the crushing roll is located at least one supply line for the cooling medium with outlet openings in the form of nozzles in the hollow cavity of each individual crushing spike and the hollow space of each individual crushing spike is connected with the hollow space in the crushing roll through return openings for the heated cooling medium in the wall of the crushing roll, and the crushing roll is equipped with a drain. If only one feed line is used for the cooling medium, all of the nozzle outlet openings are connected with the supply lines by means of connecting tubes. With several supply lines the nozzle-type outlet openings can be connected with the appropriate supply line either directly or by means of short connecting lines. The cooling media to be considered are those described for the cooling of the crushing teeth.

A significant improvement consists in the fact that the crushing roll member is designed as a tube. This achieves the best durability values at torsion loads.

A significant improvement lies in the fact that the nozzle-type openings are located by means of extension pieces in the hollow cavities of the crushing teeth in the vicinity of the working surfaces of the crushing spikes to be cooled. This achieves an especially good cooling of the working surfaces, especially if the hollow space is completely filled with the cooling medium, since a strong turbulence of the flow is produced at the working surfaces. The direction of the flow of the cooling medium directly on the working surfaces is considerably improved as compared to outlet openings which end at about the level of the wall of the outer covering.

BRIEF SUMMARY OF THE INVENTION

A sinter crushing machine having a crushing screen member and a crushing roll member, the crushing roll member having hollow crushing spike elements projecting therefrom, wherein the crushing screen is a hollow housing connected in fluid conducting relation; to hollow crushing teeth elements, with fluid circulating means arranged to distribute cooling fluid through the crushing screen and roll, with nozzle means provided in the hollow cavity of each crushing tooth and spike element for flushing its interior with cooling fluid. Preferably, the crushing roll has nozzle means in each of the crushing spikes for the turbulent contact of the fluid with the interior thereof. The preferred housing for the crushing screen member and for the crushing roll member comprises concentric inner and outer tubular members with coolant charged through the inner tubular member and through nozzles into the hollow teeth or spikes, with cooling fluid which has become heated within the tooth and spike elements passing through the outer tubular member for discharge from the housing.

BRIEF DESCRIPTION OF THE DRAWINGS

The present invention is illustrated in the accompanying drawings in which.

DESCRIPTION OF THE PREFERRED EMBODIMENT

Figure 1:
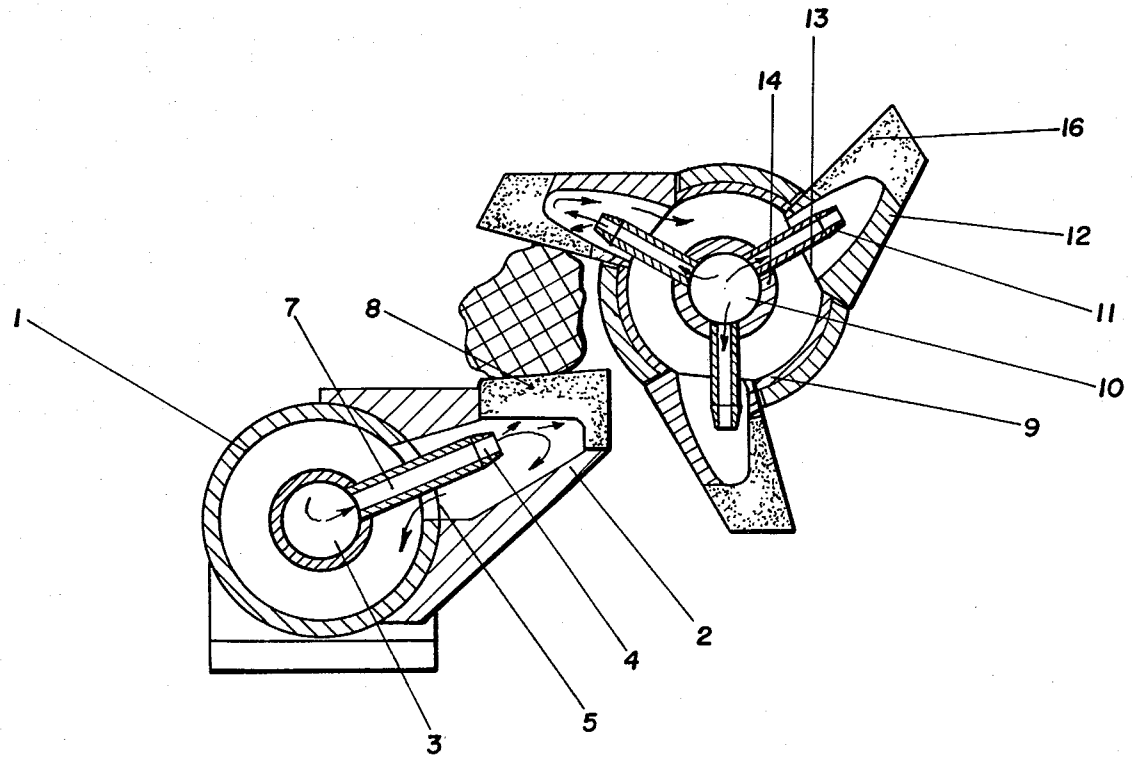
FIG. 1 is a cross-section of the sinter breaker. The cross-section of the crushing screen member, which is shown on the right of the figure, is taken along line A—A of FIG. 2. The cross-section of the crushing roll member, which is shown on the left of the figure, is taken along line B—B of FIG. 3.
Figure 2:
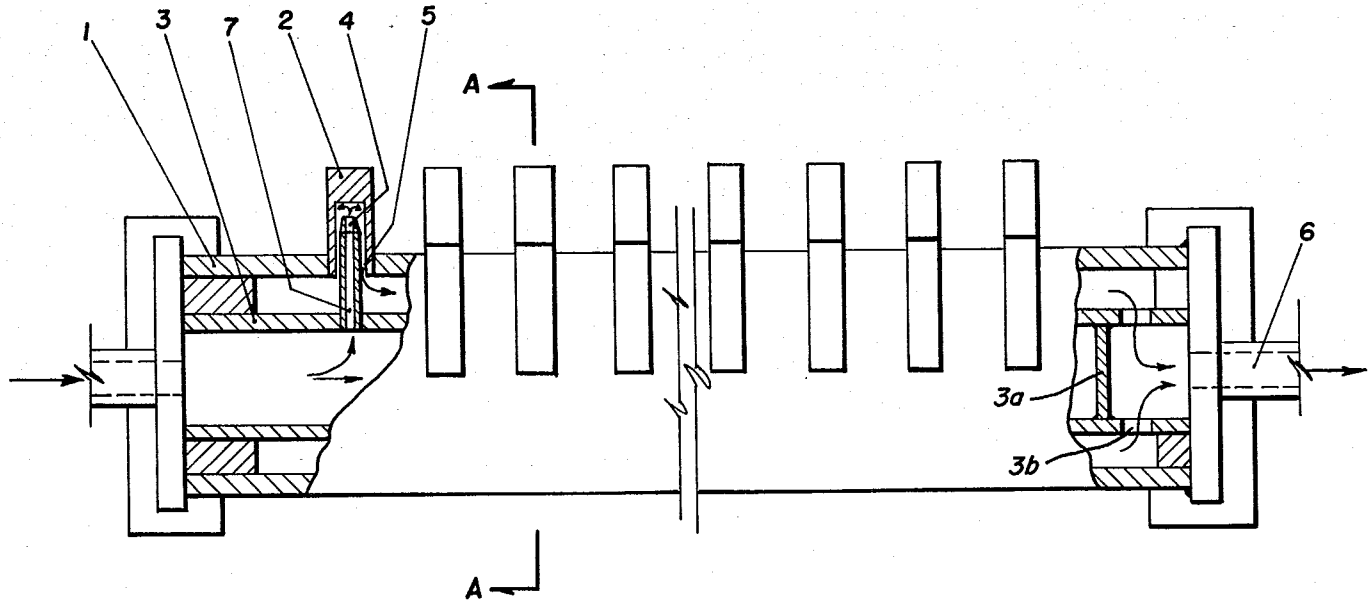
FIG. 2 is a top view of the crushing screen with partial cutaway sections.

Referring to FIGS. 1 and 2, the bracketed crushing screen member consists of an elongated hollow outer cover structure 1, which is designed as a tube, and spaced hollow crushing teeth elements 2 which are attached to it and project therefrom in a manner to provide a support for hot sinter lumps or agglomerates supplied thereto. Within the outer covering is a supply line 3 for the cooling medium. From the supply line 3, outlet openings in the form of nozzles 4 lead through the wall of the outer covering 1 into the cavities of the individual crushing teeth elements 2. The interior cavity of each individual crushing tooth 2 is connected by means of return openings 5 in the wall of the outer covering 1 with the hollow interior space of the outer covering 1. The outer covering 1 has an outlet 6 at one end for disposal of the cooling medium after it has been heated. The cooling medium is introduced into the interior cavities of the crushing teeth 2 by means of individual tubes 7 leading from the supply line 3 into the cavity of each separate tooth element. The cooling medium is directed to the vicinity of the working surfaces 8 of the crushing teeth. The working surfaces 8 preferably consist of a carbide metal. That portion of the total cooling medium which is conducted out of the supply line 3 through the tubes 7 and the nozzles 4 into the interior cavities of each individual crushing tooth 2 where it flows directly onto the underside of the working surfaces 8 and forms a turbulent flow pattern. The cooling medium then flows through the return openings 5 in the hollow space of the outer covering 1 and through the drain 6 out of the outer covering 1.

Figure 3:
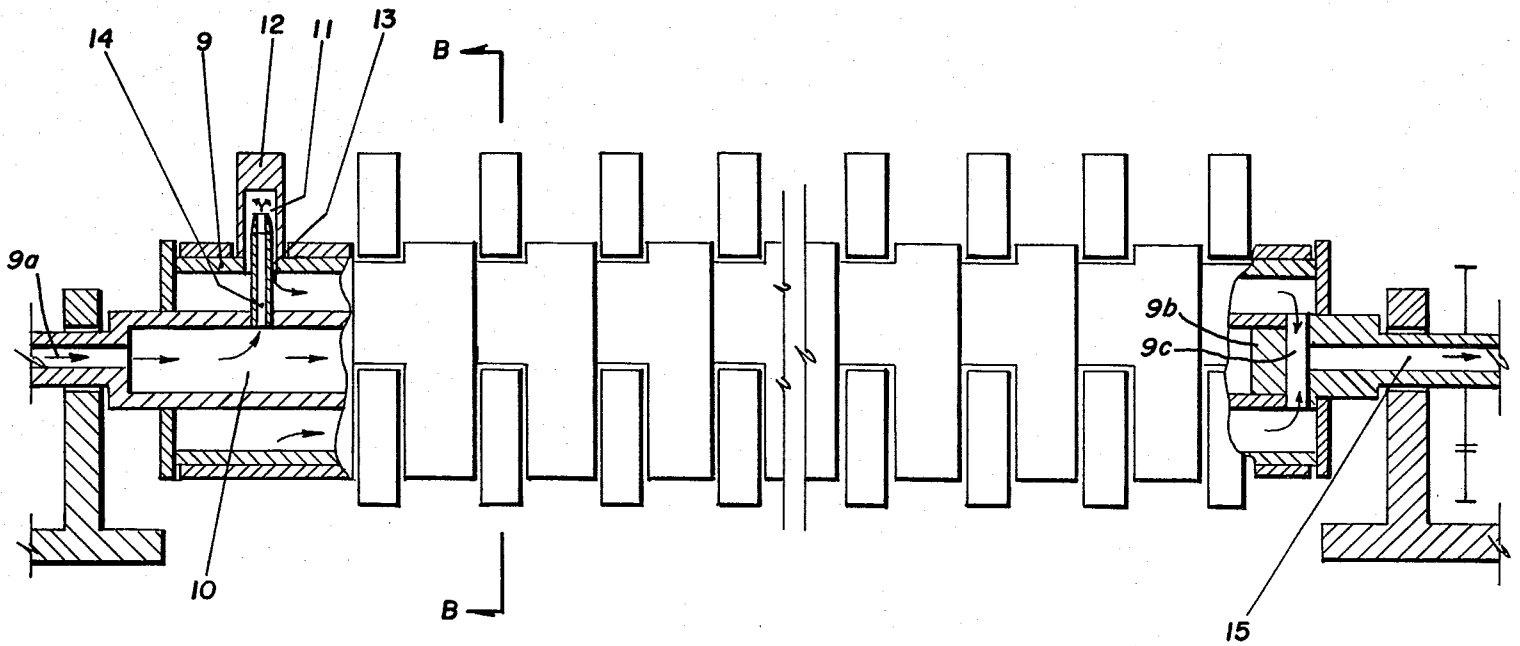
FIG. 3 is a top view of the crushing roll with a partial cutaway sections.

Referring to FIGS. 1 and 3, it can be seen that the crushing roll member 9 is also an elongate structure, being tubular in shape. A supply line 10 for the cooling medium is located in its interior portion and, from the supply line 10, extension pieces 14 and nozzles 11 direct the cooling medium into the interior cavities of the crushing spike elements 12 and to the vicinity of the working surfaces of the crushing spike elements 12. Return openings 13 for the cooling medium are located in the wall of the crushing roll 9 for the interior cavity of each individual crushing spike. The cooling medium enters the interior cavities of the crushing spike elements 12, flows from there through the return openings 13 into the hollow space of the crushing roll 9 and then is withdrawn through a central outlet opening 15. The working surfaces 16 of the crushing spikes 12 preferably consist of carbide metal.

In the construction as described, the screen comprises an elongate supporting body 1, along which there is a series of spaced laterally extending teeth elements forming a support for the lumps of sinter to be crushed, diagrammatically indicated by the single lump illustrated in FIG. 1. There is a crushing roll having an elongated rotary body 9 spaced from but generally parallel with the fixed body with spike elements projecting from the periphery thereof so located as to pass between the teeth of the screen as it rotates. The rotary body 9 may be considered the hub about which the spike elements project at equally spaced angles. The teeth elements of the screen and the spike elements of the crushing roll are hollow.

Extending lengthwise within the elongate supporting body 1 of the screen member is a conduit 3 for cooling water and it, in fact, comprises a manifold from which extends a plurality of nozzles 4–7, one of which projects into each tooth element of the screen as previously described and each such tooth opens through the body 1, as indicated at 5, for the outflow of cooling water from the interior of the tooth into the body 1 which comprises a manifold concentric about the manifold 3 for the collection of spent cooling water separately discharged into it from each tooth element.

As indicated in FIG. 2, there is an inlet connection, indicated by the arrow at the left of this figure, through which cooling fluid enters the manifold 3, and there is a barrier indicated at 3*a* near the right end of this manifold beyond which incoming water cannot flow, while ports 3*b* provide for the discharge of spent cooling water from the outer manifold into the outlet connection 6 at the right end of the elongate body or tubular body 1.

As shown in FIGS. 1 and 3, the tubular hub 9 of the crushing roll is concentrically positioned about and carried by a tubular body or hollow shaft 10. Along its length, this hollow shaft has separate nozzles 14 projecting therefrom at different angles into the hollow crushing spike elements arranged along and about the tubular support member 9 into which the hollow interior of each of the spike elements is connected for the outflow of cooling fluid supplied to the interior of each spike element. Thus, as the shaft 10 comprises an inlet manifold for separately supplying a cooling medium, usually water, from a common supply line, the tubular body 10 comprises an outlet manifold into which the spent cooling fluid from the interior of each spike element is separately discharged with the manifold 10 concentric within the outer manifold 9. There is an inlet supply connection indicated by the tubular extension 9*a* at the left of FIG. 3, and there is a barrier 9*b* at the opposite end of this manifold, while ports 9*c* provide the outlet from manifold 9 into discharge connection 15.

In both the screen member and the roll member the respective inlet and outlet manifolds are parallel with each other and effectively coextensive with the length of the members of which they are parts. Since the incoming water or other cooling medium is cold and the spent water from each crushing element of the screen and roll member is heated, there is an interchange of heat between the cooling fluids along the length of the respective manifolds that tends to reduce any sharp temperature gradient along the lengths of the respective roll and screen members and hence reduce thermal stresses in these members.

By virtue of the present invention all the working surfaces are cooled with fresh cooling medium so that substantially uniform temperatures can be achieved at these working surfaces. The creation of turbulence in the cooling medium in the vicinity of the working surfaces further contributes to the efficiency of heat removal from those areas. It is further noted that the foregoing advantages are achieved even though the sinter crusher taught by the present invention is of relatively simple construction and is, consequently, relatively inexpensive to acquire and maintain.

We claim:

1. A sinter crushing machine having a crushing screen member with a row of spaced hollow tooth elements extending laterally from an elongate hollow body and a roll member having tooth elements projecting therefrom about the periphery thereof so arranged that tooth elements of the roll member pass between the tooth elements of the screen member to crush sinter lumps to fragments which then pass through the tooth elements of the screen member, the improvement wherein the screen member comprises an elongate housing having spaced hollow crushing tooth elements therealong and having inner and outer concentric fluid circulating passages extending lengthwise of the housing, a tube leading from said inner passage through the outer passage into each of said hollow tooth elements into which it discharges a cooling fluid, a fluid outlet leading from each tooth element through which cooling fluid from each tooth enters the outer passage, means at one end of the housing for introducing cooling fluid into the inner passage, and means at the other end of the housing for discharging spent cooling fluid from the outer passage.

2. In the sinter crushing machine defined in claim 1, the improvement wherein said housing is tubular in shape.

3. In the sinter cooling machine defined in claim 2, the improvement wherein each of the tubes leading from said inner passage into said tooth elements terminates as a nozzle.

4. In a sinter breaker of the type having a screen member with laterally extending crushing tooth elements therealong and roll members with radially projecting crushing tooth elements, said screen and roll members being arranged in such relation that the tooth elements on the roll members pass between the tooth elements to thereby crush sinter lumps supplied to and retained on the screen and crush such lumps into fragments that pass between the tooth elements of the screen, the improvement wherein:

(a) at least one of said members comprises a hollow elongated supporting structure with hollow crushing tooth elements projecting therefrom at spaced intervals therealong with their hollow interiors opening into the interior of the hollow elongate structure whereby said hollow elongate structure comprises a manifold to separately receive from each projecting crushing tooth element cooling fluid that has been introduced into the interior of the several projecting crusher tooth elements, and (b) said hollow supporting element also comprises a second manifold extending along a generally parallel with said first manifold with separate nozzle tubes projecting therefrom into the hollow interior of said crusher tooth elements through which cooling fluid is separately injected into the interiors of each of the respective hollow crusher tooth elements on said supporting structure.

5. A sinter breaker as defined in claim 4 in which the second manifold of that elongate supporting structure to the tooth elements of which nozzle tubes inject cooling fluid is contained within and in spaced relation to the interior of the supporting structure and wherein said nozzle tubes extend transversely through the first manifold into the interior of the respective crusher tooth elements in which they terminate.

6. A sinter breaker as defined in claim 5 wherein the second manifold has an inlet terminal at one end of the member of which it is a part and is closed at its other end and wherein the first manifold has an outlet connection at the end of the member of which it is a part opposite the end at which the inlet connection is located.

7. A sinter breaker as defined in claim 4 in which the elongated supporting structure is tubular and the second manifold is substantially concentrically positioned with the first and is of smaller diameter than the first manifold, and wherein both manifolds are effectively coextensive with the length of supporting structure along which the spaced projecting crusher tooth elements are located with the second manifold having an inlet connection at one end of the supporting structure and the first manifold has an outlet connection at the opposite end of said supporting structure.

* * * * *